US007654793B2

(12) United States Patent
Savage

(10) Patent No.: US 7,654,793 B2
(45) Date of Patent: Feb. 2, 2010

(54) FAN SHROUD SUPPORTS WHICH INCREASE RESONANT FREQUENCY

(75) Inventor: John R. Savage, Rochester Hills, MI (US)

(73) Assignee: Valeo Electrical Systems, Inc., Auburn Hills, MI (US)

( * ) Notice: Subject to any disclaimer, the term of this patent is extended or adjusted under 35 U.S.C. 154(b) by 376 days.

(21) Appl. No.: 11/128,880

(22) Filed: May 13, 2005

(65) Prior Publication Data

US 2006/0257252 A1 Nov. 16, 2006

(51) Int. Cl.
*F03B 11/02* (2006.01)

(52) U.S. Cl. ..... 415/208.2; 415/208.4; 416/247 R

(58) Field of Classification Search ..... 415/191, 415/192, 194, 195, 208.4, 208.1, 208.2, 119, 415/185; 416/247 R
See application file for complete search history.

(56) References Cited

U.S. PATENT DOCUMENTS

| | | | | |
|---|---|---|---|---|
| 2,154,313 | A | | 4/1939 | McMahan |
| 2,219,499 | A | | 10/1940 | Troller |
| 2,397,169 | A | | 3/1946 | Troller et al. |
| 3,088,695 | A | * | 5/1963 | Clark ..... 244/12.3 |
| 3,173,604 | A | | 3/1965 | Sheets et al. |
| 4,181,172 | A | | 1/1980 | Longhouse |
| 4,253,800 | A | | 3/1981 | Segawa et al. |
| 4,329,946 | A | | 5/1982 | Longhouse |
| 4,358,245 | A | | 11/1982 | Gray |
| 4,474,534 | A | | 10/1984 | Thode |
| 4,548,548 | A | | 10/1985 | Gray, III |
| 4,569,632 | A | | 2/1986 | Gray, III |
| 4,692,098 | A | | 9/1987 | Razinsky et al. |
| 4,840,541 | A | | 6/1989 | Sakane et al. |
| 5,000,660 | A | | 3/1991 | Van Houten et al. |
| 5,244,347 | A | | 9/1993 | Gallivan et al. |
| 5,320,493 | A | | 6/1994 | Shih et al. |
| 5,326,225 | A | | 7/1994 | Gallivan et al. |
| 5,342,167 | A | | 8/1994 | Rosseau |
| 5,399,070 | A | | 3/1995 | Alizaden |
| 5,513,951 | A | | 5/1996 | Komoda et al. |
| 5,577,888 | A | | 11/1996 | Capdevila et al. |
| 5,588,804 | A | | 12/1996 | Neely et al. |
| 5,624,234 | A | | 4/1997 | Neely et al. |
| 5,681,145 | A | | 10/1997 | Neely et al. |
| D386,579 | S | * | 11/1997 | Jane et al. ..... D23/412 |
| 5,758,716 | A | * | 6/1998 | Shibata ..... 165/41 |
| 5,769,607 | A | | 6/1998 | Neely et al. |
| 5,810,555 | A | | 9/1998 | Savage et al. |

FOREIGN PATENT DOCUMENTS

| | | |
|---|---|---|
| DE | 4326147 | 11/1994 |

* cited by examiner

*Primary Examiner*—Edward Look
*Assistant Examiner*—Dwayne J White
(74) *Attorney, Agent, or Firm*—Jacox, Meckstroth & Jenkins

(57) ABSTRACT

A support system for a motor within a fan shroud. Struts extending from the shroud to the motor support the motor. The struts are arranged in groups, which are spaced from adjacent groups, and each group contains a non-radial strut.

4 Claims, 6 Drawing Sheets

FAN SHROUD SUPPORTS WHICH INCREASE RESONANT FREQUENCY

The invention concerns a support system, wherein a shroud surrounds a fan, and supports extend from the shroud to a motor which drives the fan. The support system provides an increased resonant frequency, thereby reducing the tendency of vibration produced by the fan to excite vibration in the shroud, particularly torsional vibration.

BACKGROUND OF THE INVENTION

FIG. 1 illustrates a generic fan, wherein a motor M drives fan blades B. The motor is supported by struts S which extend from an external housing H, often called a shroud.

As discussed later in connection with FIG. 6, the struts S often are designed as vanes, to change the path of air flowing through the fan. Such struts are commonly called stator vanes.

In the prior art, one approach to reducing the torsional vibration is to use struts, or stator vanes, of large cross-sectional area, one of which is shown in FIG. 5. These struts can be arranged radially, as in FIG. 6, or tangentially, as in FIG. 7.

However, the large cross-sectional profile area blocks airflow indicated by the arrows A3 in FIG. 5. This blockage causes a pressure loss, which is counter-productive, because a primary purpose of the fan is to provide an increase in pressure, which induces airflow from the high-pressure region to the low-pressure region.

In addition, these large profile struts cause a pressure disturbance that migrates upstream toward the fan blades. If the fan (not shown) is in close upstream proximity to the struts, as each fan blade (not shown) cuts through the pressure disturbance, a pressure pulse is generated. Consequently, the succession of fan blades cutting the disturbances creates a succession of pressure pulses, which is perceived as a siren-type noise. The tangential orientation of FIG. 7 reduces this noise somewhat A similar comment applies if the fan is downstream of the struts, wherein the fan blades successively cut the wakes of the struts.

Therefore, while struts of large cross-section can reduce torsional vibration, they cause pressure loss and noise.

Curved stator vanes can be used, as indicated by vane V2 in FIG. 8. These have a smaller cross section, which reduces the problem of a large cross section. They also re-direct tangentially flowing air into a more axial direction which improves system pressure rise performance. However, such stator vanes can exhibit a specific type of torsional vibration.

This problem can be corrected, or reduced, by various cross-bracing schemes, as shown in FIGS. 12A-12C. FIG. 13 illustrates additional cross-bracing schemes, wherein non-radial struts are utilized.

However, these cross-bracing schemes suffer some, or all, of the following problems. One problem is that they increase cost and add mass. In some cases, the cost increase is significant, as when the system is molded from plastic resin, because a more complex mold is then required.

Another problem is that the struts increase pressure loss, and the loss is worsened at the points of intersection between two struts.

Yet another problem is that, depending on the arrangement of the struts, they can interfere with the re-direction indicated in FIG. 8. Effective re-direction of flow creates additional pressure rise which often counters the pressure loss associated with the profile and skin friction losses of the member itself. Thus the reduction of effective re-direction represents a further loss in fan system efficiency.

OBJECTS OF THE INVENTION

An object of the invention is to provide an improved cooling fan.

A further object of the invention is to provide stator vanes which support a fan, which increase resonant frequency of the stator-vane-shroud structure.

SUMMARY OF THE INVENTION

In one form of the invention, groups of struts, or stator vanes, extend from a motor to a surrounding shroud. The groups contain non-radial struts, or stator vanes.

DETAILED DESCRIPTION OF THE INVENTION

This discussion will first set forth phenomena which the Inventor has identified.

Figure 1:
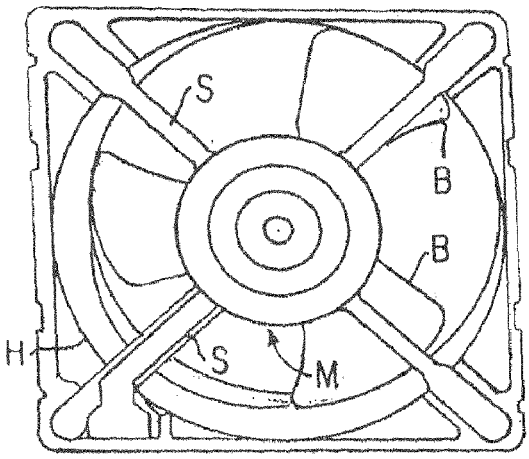
FIG-1 (PRIOR ART)
FIG. 1 illustrates a generic prior art fan having a shroud.
Figure 2:
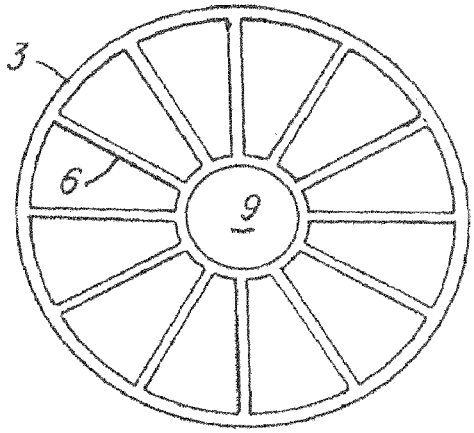
FIG-2 (PRIOR ART)
FIG. 2 illustrates struts, or stator vanes, 6 which support a motor 9 from the shroud 3.

An example of the prior art is shown in FIG. 2, which illustrates a fan shroud 3 and stator vanes 6 which support a fan motor 9. Fan blades are not shown.

Figure 3A:
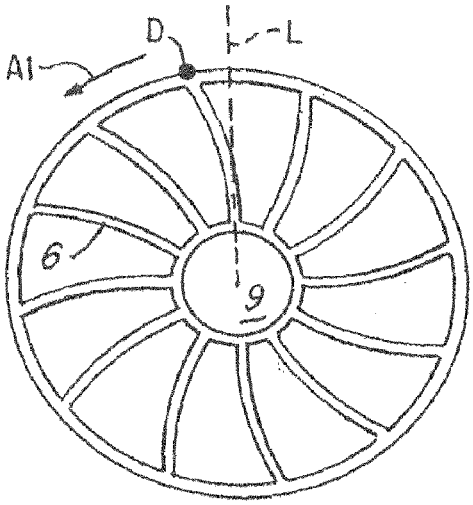
FIGS. 3A and 3B are the Inventor's depiction of torsional vibration of the shroud.
Figure 3B:
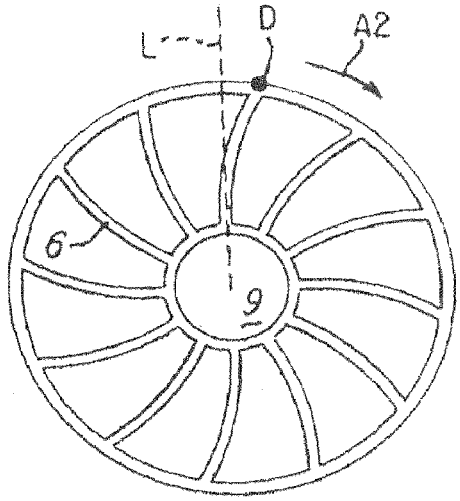

The Inventor has observed that a torsional mode of vibration can arise, which is illustrated in FIGS. 3A and 3B. A reference dot D is shown, which is fixed in position on the shroud 3, and a reference line L is also shown, which is fixed in absolute position.

During the torsional mode of vibration, the dot alternates between moving away from line L, in the direction of arrow A1, and then moving in the opposite direction, in the direction of arrow A2. The shroud oscillates between the two positions shown in the Figure. During the torsional vibration, the stator vanes 6 bend, as roughly indicated by their curvature.

Figure 4:
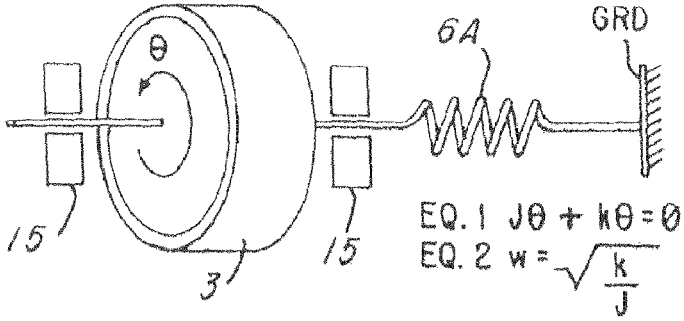
FIG. 4 is a mathematical model of the shroud.
Figure 5:
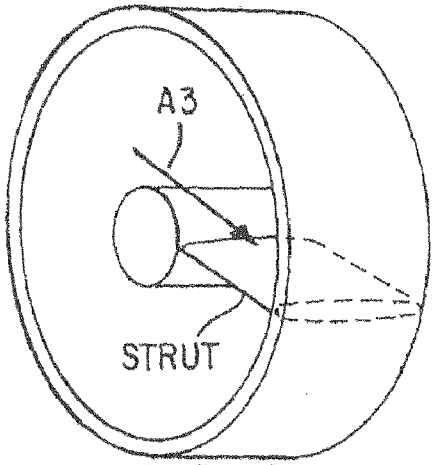
FIG-5 (PRIOR ART)
FIG. 5 illustrates a strut of large cross-sectional area.

One solution to reducing the torsional vibration is based on the analysis indicated in FIG. 4, which models the shroud 3 as a cylinder. The cylinder has a moment of inertia J. The shroud 3 is supported by frictionless bearings 15, and is free to experience rotational displacement theta, as indicated by the arrow, but subject to torsional spring 6A, which represents the spring-force applied by the stator vanes 6 in FIGS. 2 and 3. One end of torsional spring 6A is immovable, as indicated by the ground symbol GND.

Equation EQ 1 is a differential equation describing the system. The variable k is the spring constant of torsional spring 6A, which represents the spring-force applied by the stator vanes. Equation EQ 2 is derived from a known solution to EQ 1, and indicates the resonance frequency of the system, omega. Equation EQ 2 indicates that increasing k will increase the resonant frequency.

If the resonant frequency is increased beyond the range of frequencies produced by the rotating fan and the air flowing through the fan, then the latter two elements will fail to excite the shroud 3-spring 6A system, and the torsional vibration will be suppressed.

Figure 9:
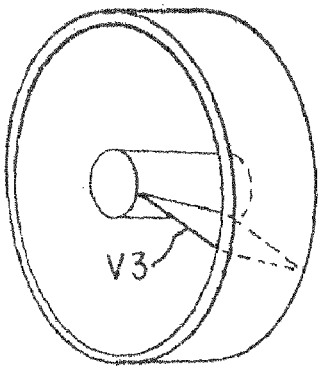
FIG-9 (PRIOR ART)
FIGS. 9, 10, and 11 illustrate how the curved vane of FIG. 8 can experience a corkscrew-type of oscillation.
Figure 10:
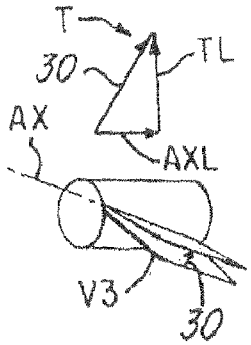

The prior art shown in FIG. 9 illustrates a simplified stator vane V3, drawn as a flat object. During torsional vibration, the vane V3 will oscillate between the two positions shown in FIG. 10. During this vibration, the vane V can be viewed as bending about axis AX. Arrow 30 indicates movement of one point on the vane.

Figure 11:
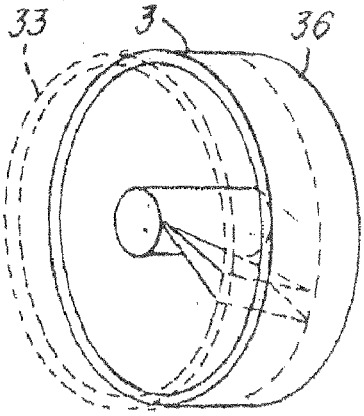
Figure 12A:
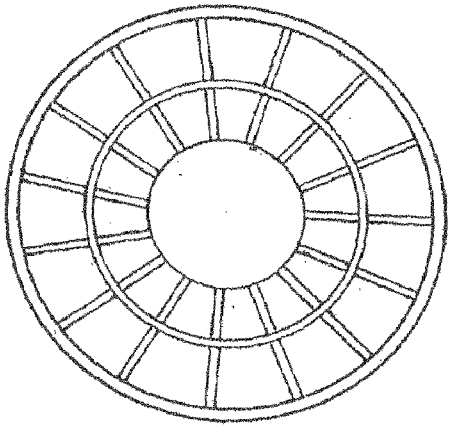
FIG-12A (PRIOR ART)
FIGS. 12A-C and 13A-B illustrate cross-bracing which reduces the oscillation of FIG. 11.
Figure 12B:
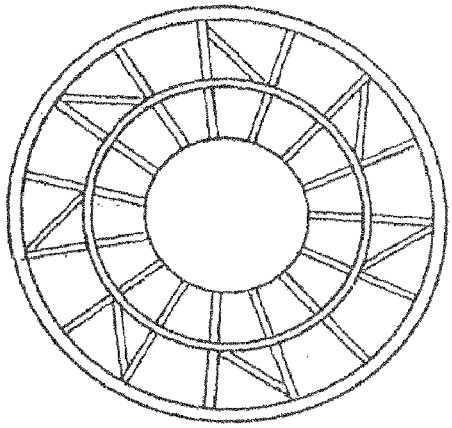
FIG-12B (PRIOR ART)
Figure 12C:
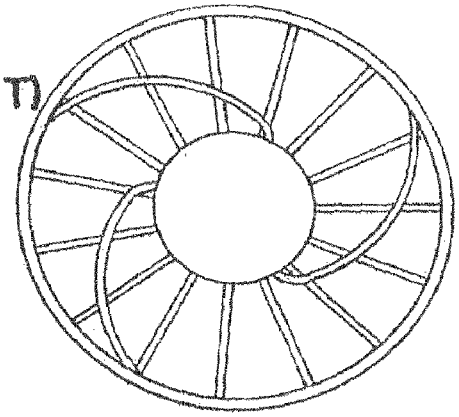
FIG-12C (PRIOR ART)
Figure 13A:
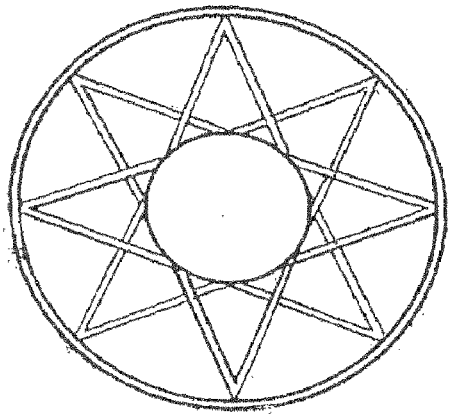
FIG-13A (PRIOR ART)
Figure 13B:
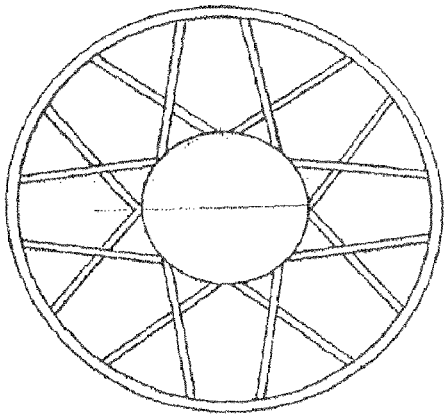
FIG-13B (PRIOR ART)

As indicated by the vector triangle T, arrow 30 can be broken into two components: axial AXL and tangential TL. The Inventor points out that AXL refers to the axis of the fan, not the axis AX in FIG. 10. Thus, the torsional vibration is not purely tangential, as in FIG. 3, but an axial component has been added. FIG. 11 illustrates how the shroud 3 moves during the torsional vibration. It follows a corkscrew-motion, between phantom position 33 and solid position 36.

Figure 14:
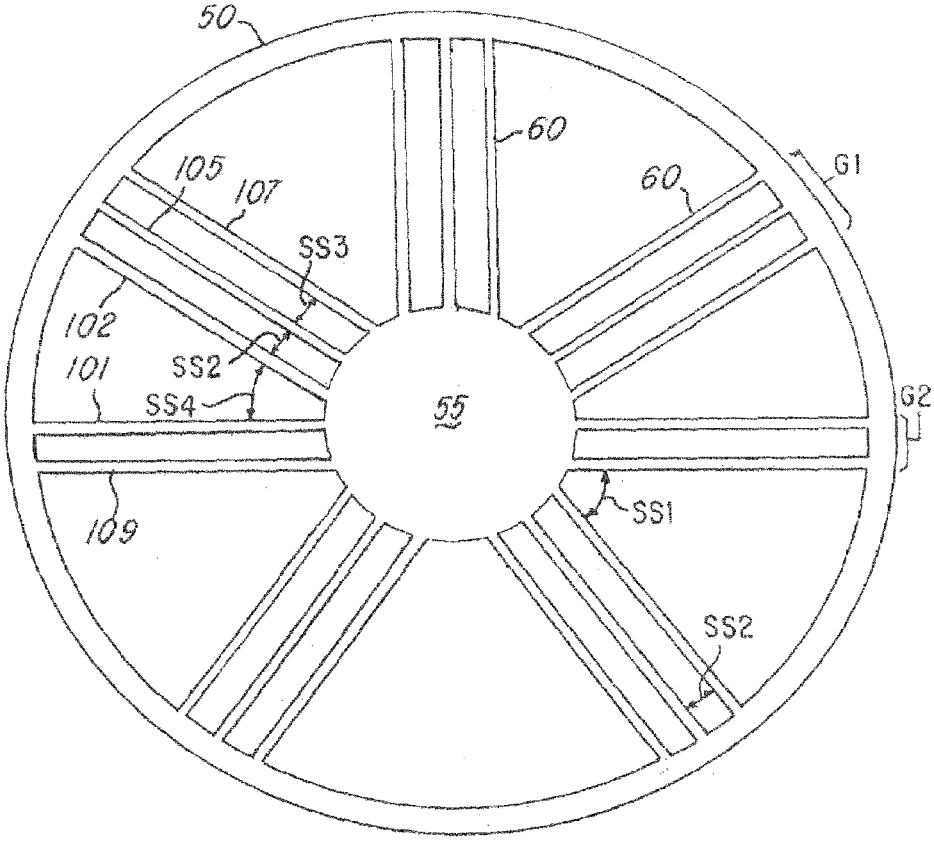
FIG. 14 illustrates one form of the invention.

FIG. 14 illustrates one form of the invention, in cross section. The shroud 50 supports motor 55, through struts or stator vanes 60. Several significant features of FIG. 14 are the following.

One feature is that the vanes exist in groups. Groups of two and three are shown. Group G1 is a group of three vanes; group G2 is a group of two vanes.

One definition of "group" is based on proximity. For example, it could be said that vanes 100 and 101 form a "group," on the grounds that they are adjacent each other, or for some other reason. However, under the invention, these vanes are not considered a group.

To determine grouping, spacing between adjacent vanes is first determined. Spacing may be measured in degrees, or in absolute distance, such as distance between radially outermost ends. However, spacings must be measured in reasonable ways. For example, the vane to vane gap associated with spacing SS1 may be similar to the vane to vane spacing gap SS2 in terms of absolute distance. However, the spacing in terms of an angular measurement scheme is very different.

The Inventor points out that the vanes in group G1 have spacing SS2 and SS3, which need not be equal. That spacing is less than the spacing SS4 between neighboring vanes 101 and 102 in the neighboring groups G1 and G2.

Another view of grouping is that vanes are bunched into clusters, which are clearly distinct from other clusters, and the distinction is apparent to the human eye. For example group G1 is clearly distinct from group G2.

A second feature is that the vanes in each group are shown as parallel, when viewed in cross section. In one form of the invention, the parallelism is preferred. In other forms of the invention, parallelism is not necessary.

A third feature is that, in each group, both radial and non-radial vanes are present. One definition of "radial" is aligned with a radius. For example, in group G1, vane 105 is radial, and vanes 102 and 107 are not radial. In group G2, vane 101 is radial, and vane 109 is not radial.

In one form of the invention, no radial vanes are present in a group. In another form of the invention, some radial vanes are present in groups. In another form of the invention, if a radial vane is present in a group, only one radial vane is present.

A fourth feature is that, no vanes which intersect with other vanes are present. Nor are inter-vane connectors present, as is the case shown in prior art FIGS. 12A-12C and 13A-13C.

Figure 15:
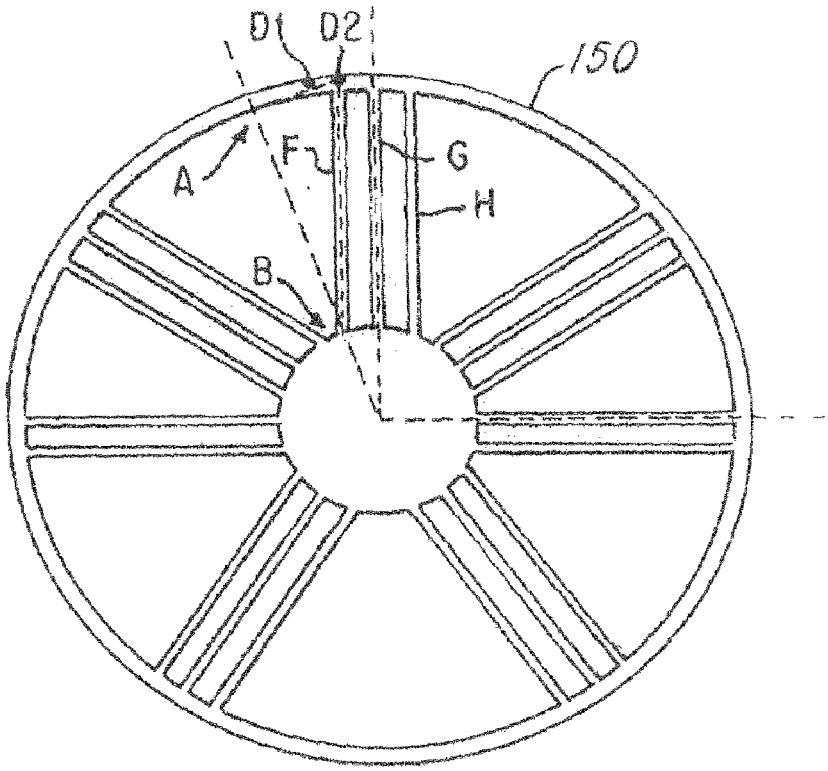
FIGS. 15 and 16 illustrate how different struts under the invention experience different deformations.

FIG. 15 illustrates displacement which occurs during torsional oscillation. Dot D1 is fixed to the shroud 150, and moves to position D2 when displacement occurs.

Figure 16:
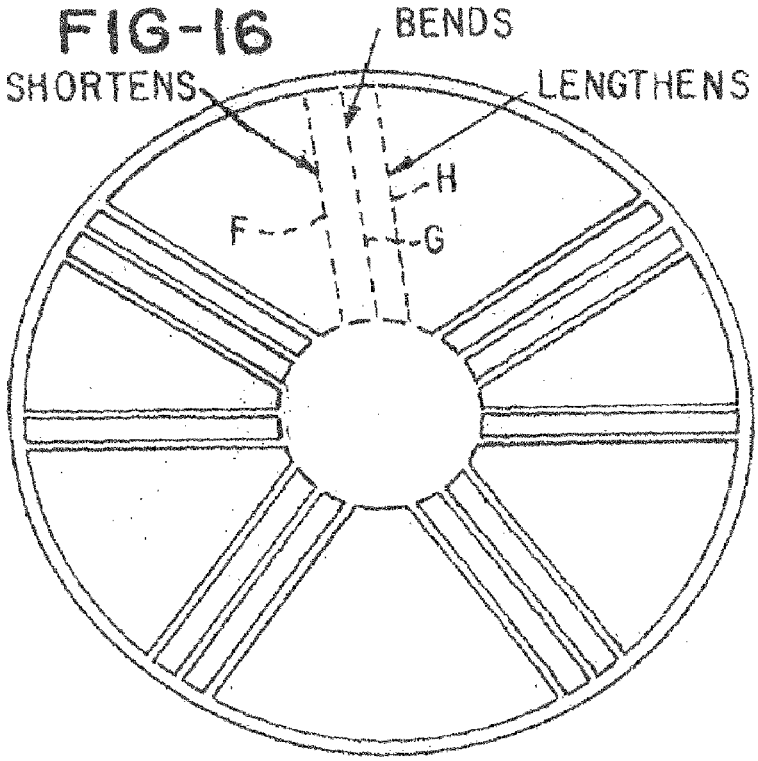

As triangle A-D1-B indicates, strut F will shorten during this displacement. That is, strut F is the hypotenuse of this triangle A-D1-B. That hypotenuse shortens as D1 moves to D2, and if the movement continued to point A, the hypotenuse would become a radius. FIG. 16 indicates the shortening.

Vane G, a radial vane, can be viewed as bending, as indicated in FIG. 16.

A similar triangle can be drawn for vane H, which will indicate that vane H lengthens, as FIG. 16 indicates. In fact, triangle A-D1-B can be used, since vane H is a mirror image of vane F. If vane F is deemed to move from point D2 to D1, vane F will lengthen. A mirror-image triangle, with vane G as the mirror, will show that vane H also lengthens when the shroud moves from point D1 to D2.

FIG. 16 indicates that, during torsional oscillation, vane F experiences compression, or column loading. Vane G experiences bending. Vane H experiences tensile loading.

Figure 17:
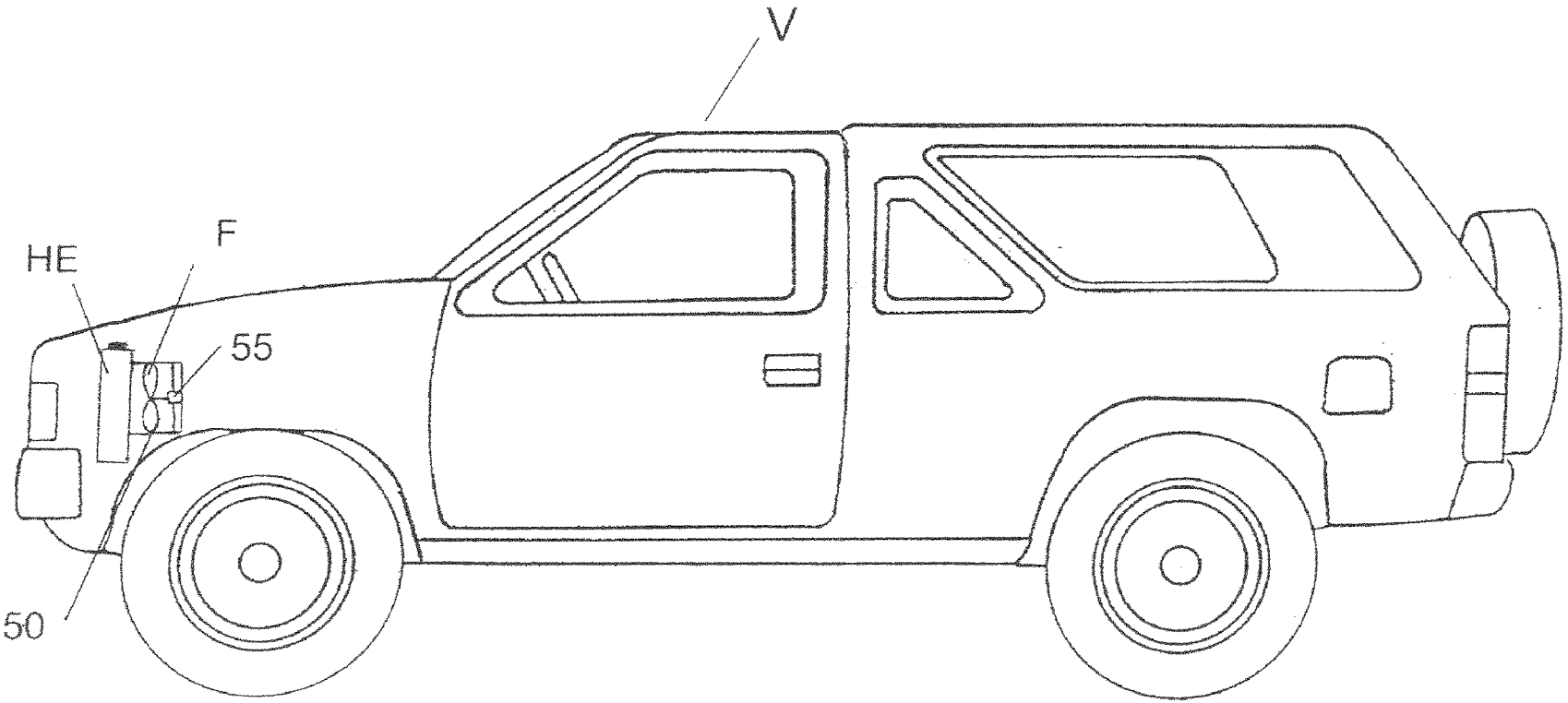
FIG. 17 shows a fan in operative relationship with a heat exchanger that is mounted on a vehicle; a motor which drives the fan and a shroud surrounding the fan.

FIG. 17 is a view of the embodiment showing the fan F surrounded by a shroud 50 which is operatively associated with the heat exchanger HE. The fan F is driven by the motor 55 which is mounted on the vehicle V.

Additional Considerations

One. It was stated that, in FIG. 14, the shroud 50 supports the motor 55. The converse is possible, the motor 55 may support the shroud 50 through the struts 60.

Figure 8:
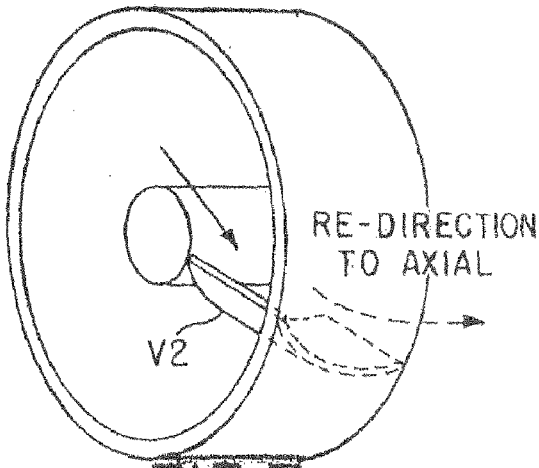
FIG-8 (PRIOR ART)
FIG. 8 illustrates a curved strut, or vane, of smaller cross-section than in FIG. 5.
Figure 6:
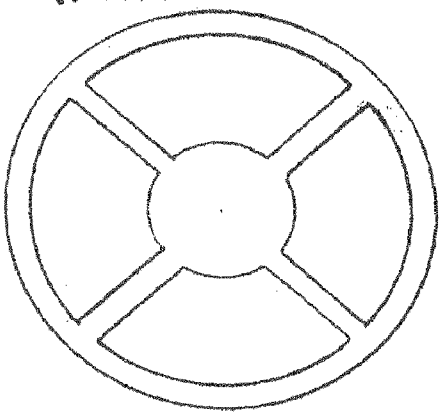
FIG-6 (PRIOR ART)
FIGS. 6 and 7 illustrate orientations which the strut of FIG. 5 can assume.
Figure 7:
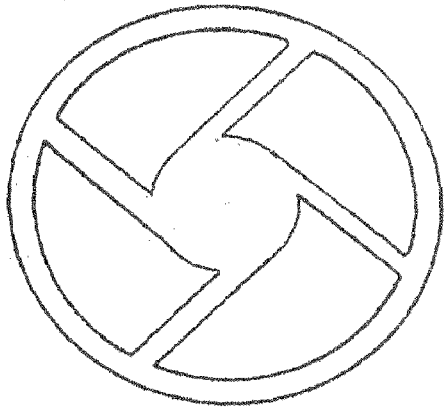
FIG-7 (PRIOR ART)

Two. FIG. 14 is a cross-sectional view of a three-dimensional object. That is, vanes have a three-dimensional shape, as FIG. 8.

Whether vanes are parallel can be determined by comparing cross sections, as in FIG. 14. Alternately, in a cross section, an axis can be assigned to each vane, and parallelism of the axes can be evaluated. This approach can be used for vanes which taper from root to tip.

These concepts apply to determining whether a vane is radial.

Three. In one form of the invention, the fan-shroud system described herein is used in a vehicle. For example, the system can be used to cool the radiator which cools the engine.

Four. The spacing of the groups is, in general, arbitrary. For example, FIG. 14 shows five groups of type G1. They can be uniformly distributed, with each at the apex of a regular pentagon. Or they can be non-uniformly spaced. A similar comment applies to the groups of type G2.

Numerous substitutions and modifications can be undertaken without departing from the true spirit and scope of the invention. What is desired to be secured by Letters Patent is the invention as defined in the following claims.

The invention claimed is:

1. An apparatus, comprising:

a) a fan;

b) a motor which drives the fan:

c) a shroud surrounding the fan and situated in operative relationship with a heat exchanger that is mounted on a vehicle, said shroud comprising a plurality of groups of struts comprising a first group of struts and a second group of struts;

d) said first group of struts, including i) a first strut extending from the motor to the shroud in a radial direction; and ii) a first plurality of companion struts, parallel with the first strut; and e) said second group of struts, including i) a second strut extending from the motor to the shroud in a radial direction; and ii) a second plurality of companion struts, parallel with the second strut;

a third group of struts, including: a third strut extending from the motor to the shroud in a radial direction; and a third plurality of companion struts, being parallel with the third strut; wherein a total number of said second plurality of companion struts is less than a total number of said first plurality of companion struts, said fan, shroud and motor being mounted on the vehicle in operative relationship with said heat exchanger; and wherein no strut-to-strut bracing is present along spans of struts.

2. An apparatus, comprising:

a) a fan;

b) a motor which drives the fan;

c) a shroud surrounding the fan;

d) a first group of struts, including:

i) a first strut extending from the motor to the shroud in a radial direction; and ii) a first plurality of companion struts, parallel with the first strut; and e) a second group of struts, including:

i) a second strut extending from the motor to the shroud in a radial direction;

ii) a second plurality of companion struts, parallel with the second strut;

f) a third group of struts, including:

i) a third strut extending from the motor to the shroud in a radial direction; and ii) a third plurality of companion struts, being parallel with the third strut; wherein a total number of said second plurality of companion struts is less than a total number of said first plurality of companion struts.

3. The apparatus according to claim 2, wherein said second plurality of companion struts is at least one less than said total number of said first plurality of companion struts.

4. An apparatus, comprising:

a) a fan in operative relationship with a heat exchanger that is mounted on a vehicle;

b) a motor which drives the fan;

c) a shroud surrounding the fan;

d) a first group of struts, including:

i) a first strut extending from the motor to the shroud in a radial direction; and ii) a first plurality of companion struts, parallel with the first strut; and e) a second group of struts, including:

i) a second strut extending from the motor to the shroud in a radial direction;

ii) a second plurality of companion struts, parallel with the second strut;

f) a third group of struts, including:

i) a third strut extending from the motor to the shroud in a radial direction; and a third plurality of companion struts, being parallel with the third strut; wherein a total number of said second plurality of companion struts is less than a total number of said first plurality of companion struts; third strut;

said fan, motor and heat exchanger being mounted on said vehicle in operative relationship to facilitate heat exchange; and wherein all of said third plurality of companion struts are parallel.

* * * * *